US007069913B1

(12) United States Patent
Crary

(10) Patent No.: US 7,069,913 B1
(45) Date of Patent: Jul. 4, 2006

(54) FUEL DELIVERY SYSTEM FOR A COMBUSTION ENGINE

(75) Inventor: Lynwood F. Crary, Preston, CT (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 0 days.

(21) Appl. No.: 11/206,478

(22) Filed: Aug. 18, 2005

(51) Int. Cl.
*F02M 37/04* (2006.01)

(52) U.S. Cl. ..... 123/509; 123/514

(58) Field of Classification Search ..... 123/509, 123/514; 137/265, 574, 576, 565.33
See application file for complete search history.

(56) References Cited

U.S. PATENT DOCUMENTS 4,860,714 A * 8/1989 Bucci ..... 123/514
5,078,169 A * 1/1992 Scheurenbrand et al. ... 137/574
5,170,764 A 12/1992 Tuckey
5,983,932 A 11/1999 Wagner et al.
6,276,342 B1 * 8/2001 Sinz et al. ..... 123/514
6,283,142 B1 9/2001 Wheeler et al.
6,343,589 B1 2/2002 Talaski et al.
6,371,153 B1 4/2002 Fischerkeller et al.
6,712,234 B1 * 3/2004 Boecker ..... 220/563
6,792,966 B1 * 9/2004 Harvey ..... 137/265
6,845,782 B1 * 1/2005 Osterkil et al. ..... 137/1
6,871,640 B1 3/2005 Atwood et al.
2005/0034710 A1 2/2005 Crary et al.

* cited by examiner

*Primary Examiner*—Mahmoud Gimie
(74) *Attorney, Agent, or Firm*—Reising, Ethington, Barnes, Kisselle, P.C.

(57) ABSTRACT

A fuel delivery system with at least one fuel tank and at least two fuel chambers has a fuel transfer assembly preferably integrated into an in-tank fuel pump module for controlling fuel levels between the at least two fuel chambers. The fuel transfer assembly has a transfer jet which receives pressurized fuel from a fuel pump of the module and at least two control valves for dictating the source of low pressure fuel flowing into the transfer jet and discharged therefrom preferably into a fuel reservoir of the module. Preferably, one control valve is located in each fuel chamber. The control valve opens upon a pre-established high fuel level and closes upon low fuel level. The fuel chamber containing the open control valve is generally the source of fuel for the fuel pump module.

26 Claims, 5 Drawing Sheets

FUEL DELIVERY SYSTEM FOR A COMBUSTION ENGINE

FIELD OF THE INVENTION

This invention relates generally to a liquid fuel delivery system of a combustion engine for a vehicle and more particularly to at least one transfer jet pump assembly of the fuel system for controlling fuel levels between at least two fuel tank chambers.

BACKGROUND OF THE INVENTION

In transportation vehicles such as trucks, cars, planes and boats, the on-board fuel tank is generally shaped to maximize fuel storage capacity yet fit within often restricted areas dictated by the surrounding vehicle structure or chassis. Often, known saddle tanks or two distinct storage tanks having generally at least two separate fuel storage chambers are incorporated into the vehicle, see U.S. Pat. No. 5,170,764, to Tuckey and assigned to Walbro Corporation, issued Dec. 15, 1992, and incorporated herein by reference in it's entirety.

Typically mounted in at least one of the two fuel chambers is an electric motor fuel pump commonly used to supply the fuel demand for the at least one engine in the vehicle. The electric fuel pump is known to be integrated into an in-tank fuel pump module typically having a filter at the pump inlet, a check valve at the pump outlet and a pressure regulator, downstream of the outlet check valve, for controlling the pressure of fuel supplied to a fuel rail mounted on the engine and returning excess fuel back to the fuel tank. A support structure of the module usually includes a flange mounted sealably to the fuel tank and a reservoir can is typically part of the module. The fuel pump is usually located in the reservoir can and draws fuel therefrom. The reservoir provides a reliable source of liquid fuel for the fuel pump even when the larger fuel chamber is relatively low of fuel and/or when the fuel within the supply chamber sloshes about due to movement of the vehicle or any other dynamics occurring relative to the vehicle.

A reservoir jet pump typically maintains adequate fuel levels in the reservoir can by routing a minority portion of pressurized fuel from the electric pump outlet and sending it through a venturi tube which in-turn aspirates a much greater amount of fuel from the fuel tank and into the reservoir. Typically the jet pump functions continuously regardless of reservoir fuel level and regardless of the fuel pressure at the pump outlet or pressure at the fuel rail. It is thus common for fuel in the reservoir can to overflow back into the fuel chamber.

In vehicle applications having only one fuel pump, thus drawing fuel from only one of the at least two fuel chambers, a gravity fed syphon or transfer line typically communicates between the two chambers to maintain equal fuel levels and prevent one chamber from dominating another. Unfortunately, in some applications placing a transfer line near or below the bottom of the two fuel tank chambers is not practical due to surrounding vehicle structure or safety concerns. Furthermore, in other applications the two fuel chambers or separate tanks may be located at entirely different elevations, yet maintaining substantially equal volumes of fuel in each tank is still desirable for vehicle maneuvering performance or ballast.

In some vehicle applications having high fuel consumption, such as a truck having a large combustion engine, or a boat or plane having two engines, it is desirable to have an electric motor fuel pump module in each fuel tank chamber, see U.S. Pat. No. 6,371,153, to Fischerkeller, et al, issued Apr. 16, 2002, and incorporated herein by reference in its entirety. Because both fuel pumps must operate reliably, it is imperative that the storage of fuel in one fuel chamber does not dominate over the other chamber and that both chambers have fuel therein at relatively low fuel level or nearly empty conditions.

SUMMARY OF THE INVENTION

A fuel delivery system for a fuel tank having at least two fuel chambers or two separate fuel tanks each having a chamber has a fuel transfer assembly preferably integrated into an in-tank fuel pump module for controlling fuel levels between the at least two fuel chambers. The transfer assembly has a transfer jet which receives pressurized fuel from a fuel pump of the module and at least two control valves for dictating the source of low pressure fuel flowing into the transfer jet and discharged therefrom preferably into a fuel reservoir of the module. Preferably, one control valve is located in each fuel chamber. The control valve opens upon a pre-established high fuel level and closes upon a low fuel level. The fuel chamber containing the open control valve is generally the source of fuel for the fuel pump module and fuel is generally not drawn from the fuel chamber containing a closed control valve.

Preferably, each fuel supply chamber is associated with a respective fuel pump, a transfer jet and a control valve. The control valves for respective chambers communicate with one-another by a transfer conduit extending between transfer ports of the valves. Fuel flows in either direction within the transfer conduit generally depending upon which fuel chamber has a higher demand/need for fuel. An outlet port of each valve communicates continuously with the respective transfer port preferably through the valve body, and communicates with the low pressure inlet of the respective transfer jet. An inlet port or valve seat of each control valve communicates directly and intermittently with the respective fuel supply chamber. When fuel level in a first fuel chamber is low and fuel level in a second chamber is high, the inlet port of the first control valve in the first chamber is closed, the inlet port of the second control valve in the second chamber is open, and during operation, fuel flows through the transfer conduit from the open inlet port of the second control valve, generally through the first control valve into the transfer jet of the first chamber as aspirated fuel.

Objects, features and advantages of this invention include a vehicle having at least two fuel supply chambers with controlled fuel levels so that one fuel chamber does not empty before, or dominate over the other fuel chamber. Yet another advantage of the invention is the ability to use multiple, pre-existing, fuel pump modules to meet high fuel consumption demands of a large engine or multiple engines in a single vehicle, wherein one pump module is located in each fuel supply chamber. Other advantages include a more economical and robust fuel delivery system utilizing proven fuel pump modules, improved engine performance, improved vehicle handling, and a design which is relatively simple, economical to manufacture and assemble, and requires little to no maintenance and in service has a long useful life.

BRIEF DESCRIPTION OF THE DRAWINGS

These and other objects, features and advantages of the invention will become apparent from the following detailed description of the preferred embodiment(s) and best mode, appended claims, and accompanying drawings in which:

DETAILED DESCRIPTION OF THE PREFERRED EMBODIMENTS

Figure 1:
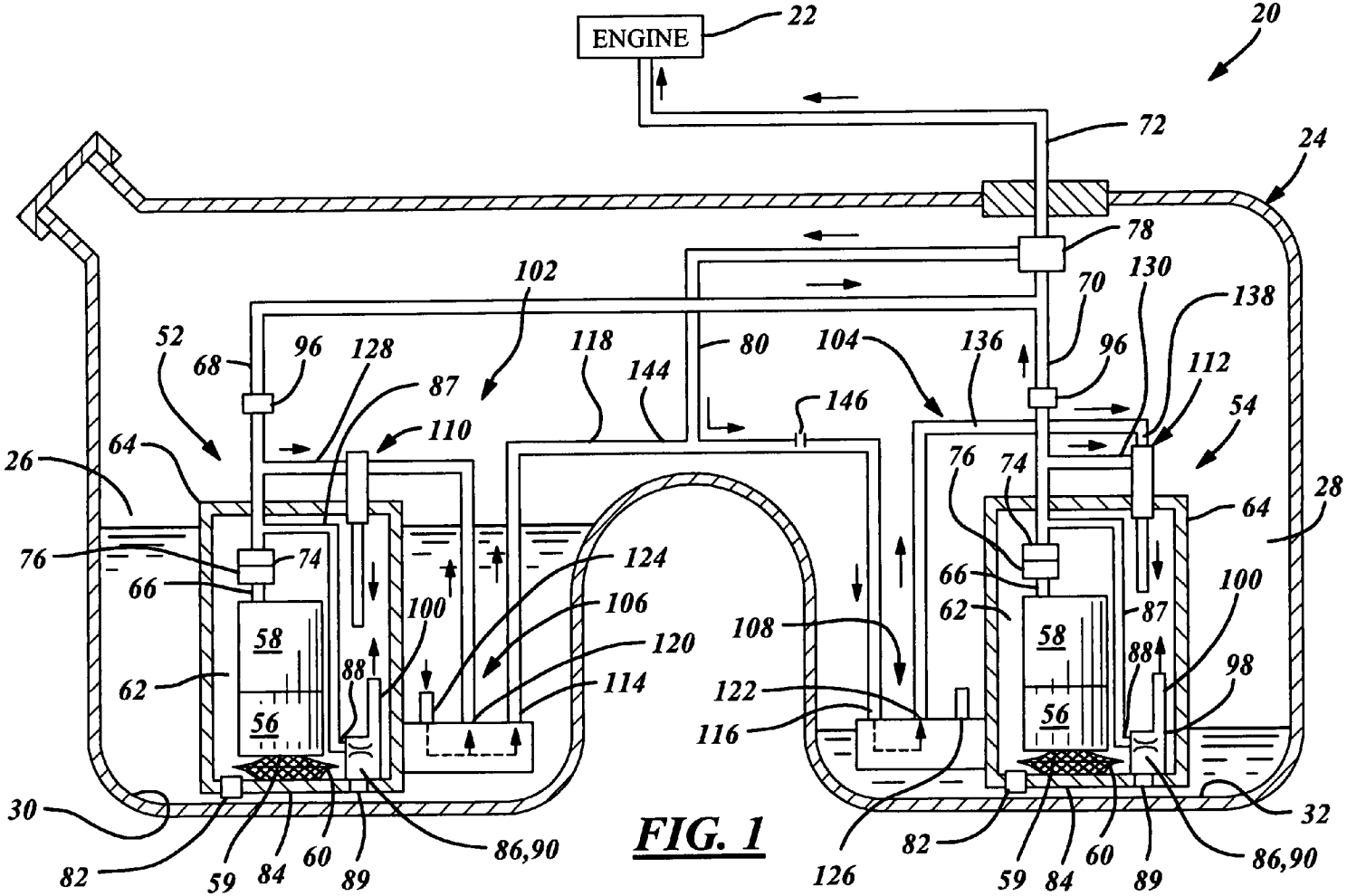
FIG. 1 is a partial section view of a fuel supply system embodying the present invention and having a first control valve in a first fuel chamber being open and a second control valve in a second fuel chamber being closed.

Referring in more detail to the drawings, FIGS. 1–4 illustrate a fuel delivery or supply system 20 for a combustion engine 22 which is preferably fuel injected. The fuel delivery system 20 has at least one fuel tank 24 which is preferably a saddle-tank typically used in rear-wheel-drive automotive vehicle applications. The at least one fuel tank 24 has a plurality of fuel chamber 26, 28 defined in-part by respective bottoms 30, 32. The plurality of fuel chambers, as illustrated, has a first fuel chamber 26 and a second fuel chamber 28, that generally communicate with one-another at an elevation which is substantially higher than the respective first and second bottoms 30, 32 for a number of practicality or structural reasons. Although the first and second fuel chambers 26, 28 are separated, the fuel delivery system 20 functions to maintain substantially equal or controlled fuel quantities or levels in each fuel chamber while meeting the fuel consumption demands of the at least one combustion engine 22.

Figure 7:
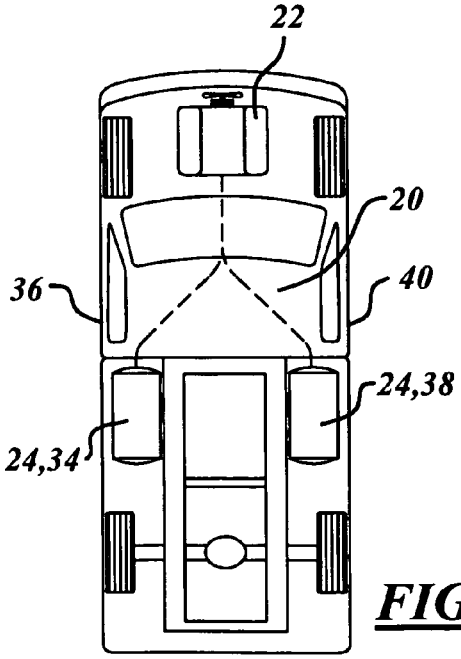
FIG. 7 is a plan view of the fuel supply system in an automotive environment.
Figure 8:
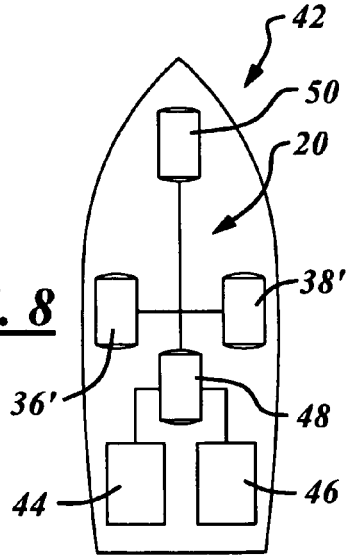
FIG. 8 is a plan view of the fuel supply system in a marine environment.

The at least one fuel tank 24 may also be two or more generally separate fuel tanks for a variety of transportation vehicles. For instance as shown in FIG. 7, large truck applications are known to have a first fuel tank 34 on the left side 36 and a second fuel tank 38 on the right side 40 which are separate and both generally supply fuel to a single large displacement combustion engine 22. Other vehicle applications can have a plurality of engines which are supplied fuel from a plurality of fuel tanks. For instance, a boat or plane 42 having a port and a starboard engine 44, 46 where any one engine is preferably supplied fuel from both a port and a starboard fuel tank 36', 38', and/or an aft and a forward fuel tank 48, 50 where ballast or weight distribution can be of concern, as best shown in FIG. 8.

Located in the first and second fuel chambers 26, 28 are respective first and second fuel pump modules 52, 54 each having a fuel pump 56 driven by an electric motor 58 supported preferably by a structure (not shown) that preferably includes a flange engaged sealably to the saddle-tank to close and seal an access hole. Each fuel pump 56 has an inlet 59 that receives fuel preferably through a filter 60, preferably of about thirty-one microns, from a fuel reservoir or sub-chamber 62 defined by a reservoir can 64. Each outlet 66 of the fuel pumps 56 delivers liquid fuel through respective supply conduits 68, 70 to a common vehicle conduit 72 which preferably supplies fuel to a fuel rail (not shown) of the combustion engine 22 preferably having a plurality of fuel injectors. Preferably, each fuel supply conduit 68, 70 communicates with the respective pump outlets through an outlet filter 74 disposed downstream of a check valve 76 of the modules 52, 54 to prevent backflow. The outlet filters 74 are typically capable of filtering at about eight microns to generally protect the fuel injectors. Downstream of the check valves 76, and preferably interposed in the vehicle conduit 72, is a single pressure regulator 78 that controls fuel pressure at the fuel rail by bypassing excess fuel out of the vehicle conduit 72 or directly out of the fuel rail. Preferably, a bypass conduit 80 returns the bypassed fuel to the respective fuel chamber 26, 28 having the lowest fuel level or requiring the most make-up fuel.

Pressure control, however, at the fuel rail may be achieved by a variety of ways with or without varying forms of a pressure regulator. For instance, each fuel pump 56 and motor 58 can be a variable-speed-type, responsive to fuel demand of the operating engine. Moreover, the fuel system in general may be of a no-return-type or may be of a return-loop-type with excess fuel returned from the engine fuel rail. Both types with corresponding pressure regulators are described in detail in U.S. Pat. No. 6,343,589, and U.S. CIP patent application Ser. No. 10/946,953, filed Sep. 22, 2004, and incorporated by reference herein in their entirety.

Preferably, an umbrella or check valve 82 located generally at a bottom 84 of each reservoir can 64 primes the reservoir with fuel when initially filling an empty saddle-tank 24 with fuel. During filling when the fuel level in the fuel chamber 26, 28 is generally higher than the fuel level in the reservoir 62, the check valve 82 opens allowing fuel to enter the respective reservoirs.

After filling of the saddle-tank 24, and when the engine 22 is running and the fuel pumps 56 are in full operation, first and second reservoir jet pumps 86 preferably function to maintain needed fuel levels in the respective reservoirs 62 for reliable pump operation and regardless of supply chamber fuel level. High pressure passages 87 communicate between the respective pressurized supply conduits 68, 70 and the high pressure nozzles or jets 88 of each jet pump for flowing fuel through the nozzles 88. Preferably, each passage 87 tees into its supply conduit 68, 70 immediately downstream of the outlet filter 74 and preferably between the upstream check valve 76 and a downstream check valve 96.

The reservoir jet pumps 86 are preferably integrated into the respective structures of the modules 52, 54 and as such each receives fuel from a first or low pressure fuel inlet port 89 defined generally by the reservoir cans 64 and located in close proximity to the respective bottoms 30, 32 of the saddle-tank 24. The low pressure inlet port 89 communicates directly with a cavity 90 defined by a housing 91 of the structure 64 and generally disposed preferably in the reservoir 62.

In the cavity 90, a venturi tube 98 is preferably press fitted or molded in the housing 91 and constructed to receive the pressurized fuel flowing through the nozzle 88. The venturi tube 98 preferably has a reduced diameter portion or throat, and fuel flow therethrough creates a pressure drop within the jet pump housing 91 to draw or aspirate fuel from the fuel chamber 26, 28, through the low pressure inlet or port 89, venturi 98 and into the reservoir 62. Fuel flowing through the venturi tube 98 from the nozzle 88 is also discharged into the reservoir 62 and may thereafter be drawn into the fuel pump 56. Preferably, a substantially vertical stand-pipe or conduit 100 is located at the outlet of the jet pump 86 and extends above to the minimum desired fuel level in the reservoirs for preventing drainage of the reservoir 62 and cavity 90 back into the fuel supply chamber 26, 28 when the jet pump 86 is inactive. Alternatively, the stand-pipe 100 can be replaced with a check valve at the outlet or the low pressure inlet 89 to prevent reservoir and cavity drainage.

More specifically, to the present invention, each pump module 52, 54 also has a fuel transfer assembly 102, 104 having a control valve 106, 108 and a transfer jet 110, 112 which operates in principle similar to the reservoir jet pumps 86 but for the different purpose of drawing excess fuel from the opposite fuel chamber. The control valves 106, 108 are preferably of a float type, each having respective transfer ports 114, 116 which communicate with one-another by a common, reversible flow, transfer passage or conduit 118; respective outlet ports 120, 122, which communicate continuously with the respective transfer ports or transfer conduit ends 114, 116, and with the respective fuel inlets 142, 138 of the transfer jets 110, 112 generally through the body of the respective control valves 106, 108; and respective isolatable inlet ports 124, 126 which preferably communicate directly with the respective fuel chambers 26, 28. Each transfer jet 110, 112 is preferably integrated into the respective pump modules 52, 54 and receives pressurized fuel from the respective outlets 66 of the pumps 56 (downstream of filter 74 and upstream of check valve 96) through respective diverting conduits 128, 130 and high pressure inlets 132, 134. The transfer jets 110, 112 have aspirated fuel outlets 135 for flowing fuel directly into the respective reservoirs 62.

Figure 5:
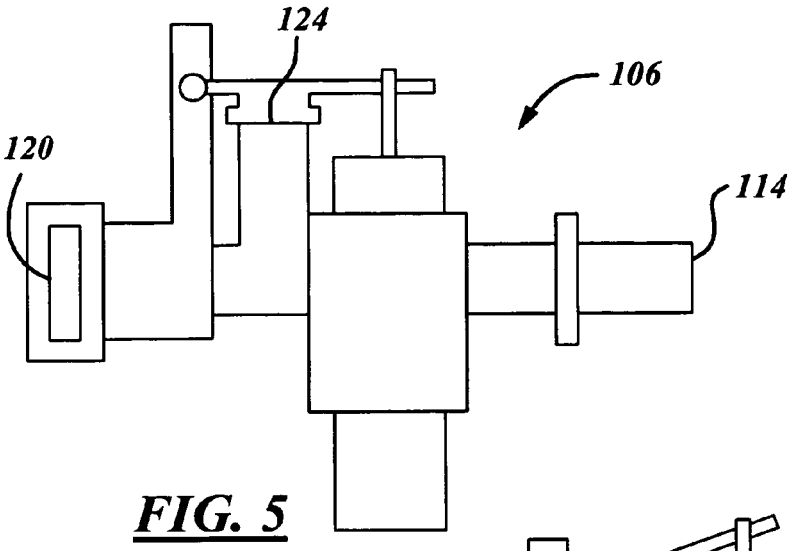
FIG. 5 is a side view of one of the control valves in the closed position.
Figure 6:
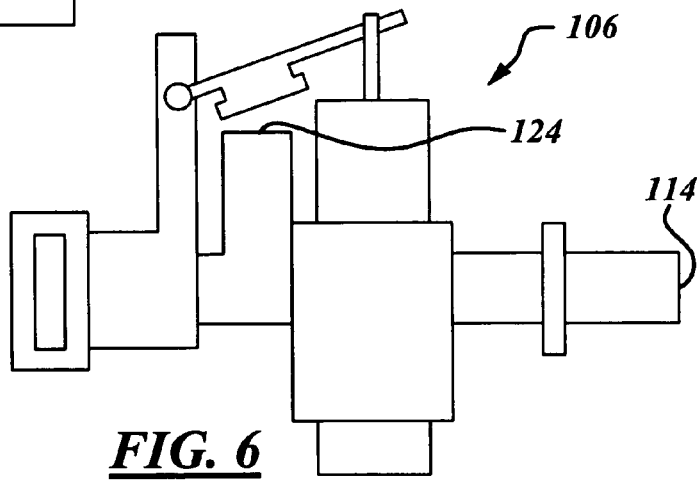
FIG. 6 is a side view of the control valve in the open position.

Referring to FIGS. 1 and 5–6, during operation when the fuel level in the first fuel chamber 26 is relatively high, the pre-established buoyancy of the first float control valve 106 acts to open the valve, thereby communicating the inlet port 124 of the first control valve 106 with the outlet port 120 and transfer port 114. As shown in FIG. 1, when the fuel level in the second chamber 28 is below a pre-set limit, the second control valve 108 closes, thereby isolating its inlet port 126 from the transfer port 116 of the second control valve 108. The second transfer port 116 receives fuel from the first chamber 26 by the transfer conduit or passage 118. This configuration of the control valves 106, 108 prevents the first transfer jet 110 from competing with the second transfer jet 112, which would deprive the second fuel chamber 28 from needed fuel. Instead, flow dynamics will cause the first transfer jet 110 to draw fuel from its own chamber 26 and dispel it into the first reservoir 62 that is capable and likely to overflow back into the first fuel chamber 26. Simultaneously, the second transfer jet 112 will receive a minority of pressurized fuel from the outlet 66 of the second fuel pump 56 through the second diverting conduit 130 and high pressure inlet 134. The venturi effect created will cause fuel to flow to the transfer jet 112 through a low pressure conduit 136, communicating with the second outlet port 122 of the second float control valve 108, and the low pressure inlet 138 of the second transfer jet 112. The low pressure conduit 136 receives fuel from the closed second control valve 108 by way of the second transfer port 116 which communicates directly with the transfer passage 118. The combined fuel from the first chamber 26 and the outlet 66 of the second fuel pump 56 is aspirated into the second reservoir 62 from the fuel outlet 135 of the second transfer jet 112. From the reservoir can 64, the aspirated fuel overflows into the second fuel chamber 28. This flow pattern will continue until the fuel level in the second fuel chamber 28 is generally restored relative to the fuel level in the first fuel chamber 26 and that is generally followed by the opening of the second control valve 108.

Figure 2:
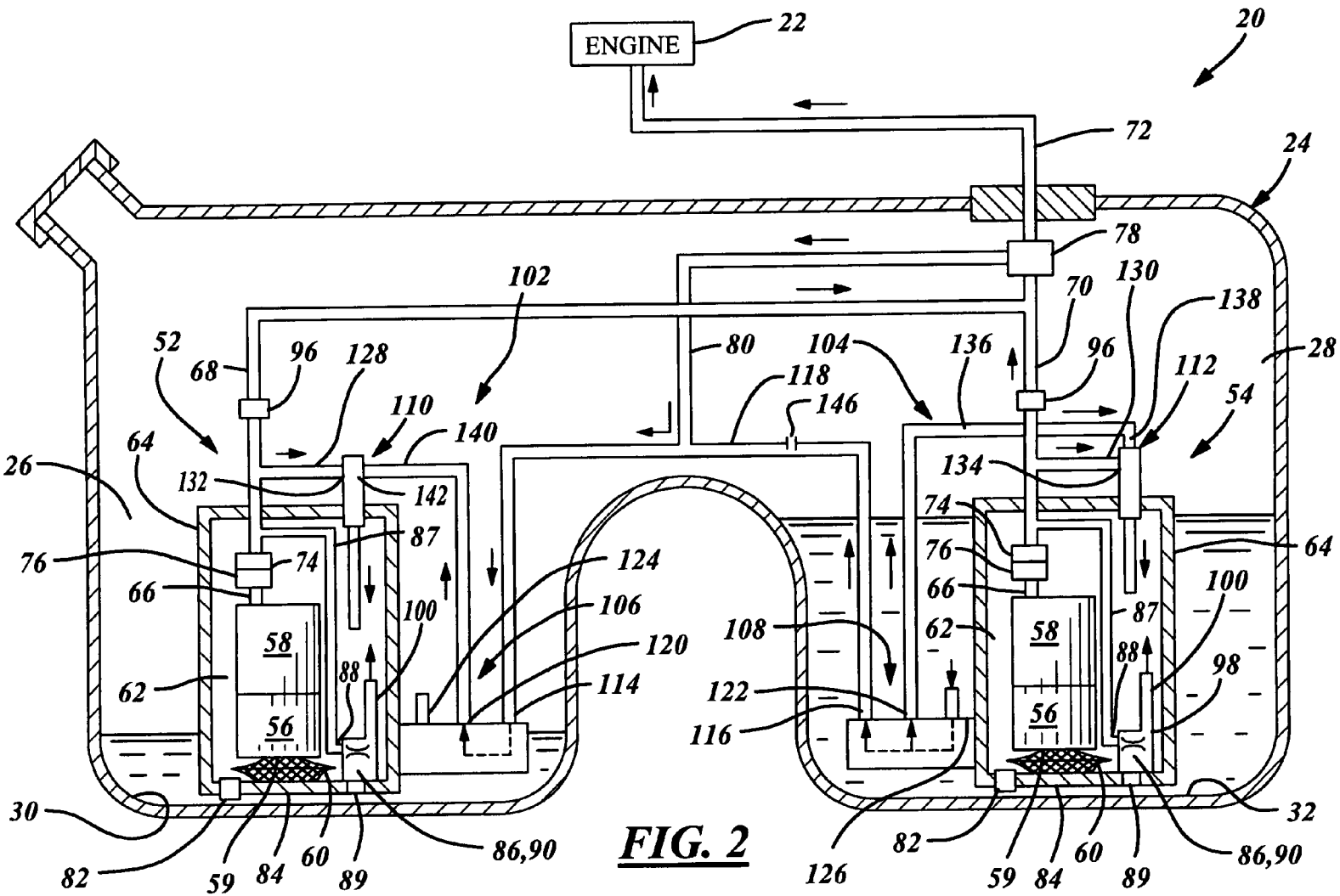
FIG. 2 is the partial section view of FIG. 1 except with the first control valve being closed and the second control valve being opened.

Referring to FIGS. 2 and 5–6, when the fuel level in the second fuel chamber 28 is high and the fuel level in the first fuel chamber 26 is relatively low, the pre-set buoyancy of the second float control valve 108 acts to open the valve, thereby communicating the inlet port 126 of the second control valve 108 with its outlet port 122 and transfer port 116. The low fuel level in the first chamber 26 causes the first float control valve 106 to close, thereby isolating its inlet port 124 from its transfer port 114. This state of the control valves 106, 108 prevents the second transfer jet 112 from competing with the recovery task of the first transfer jet 110 which would otherwise deprive the first fuel chamber 26 of needed fuel to be recovered from the second fuel chamber 28. Flow dynamics cause the second transfer jet 112 to draw fuel from its own fuel chamber 28 and dispel it into the second reservoir 62 that, like the first reservoir, is capable and likely to overflow back into the second fuel chamber 28. Simultaneously, the first transfer jet 110 will receive pressurized fuel from the outlet 66 of the first fuel pump 56 through the first diverting conduit 128 and high pressure inlet 132. The venturi effect created will cause fuel to flow through a low pressure conduit 140, communicating with the first outlet port 120 of the first float control valve 106, and the low pressure inlet 142 of the first transfer jet 110 where the combined fuel is discharged into the first reservoir 62 through the fuel outlet 135. The low pressure conduit 140 generally receives fuel from the closed first control valve 106 by way of the first transfer port 114 which communicates directly with the transfer passage 118. This flow pattern will continue until the fuel level in the first fuel chamber 26 is generally restored relative to the fuel level in the second fuel chamber 28 and the first control valve 106 consequently opens.

Figure 3:
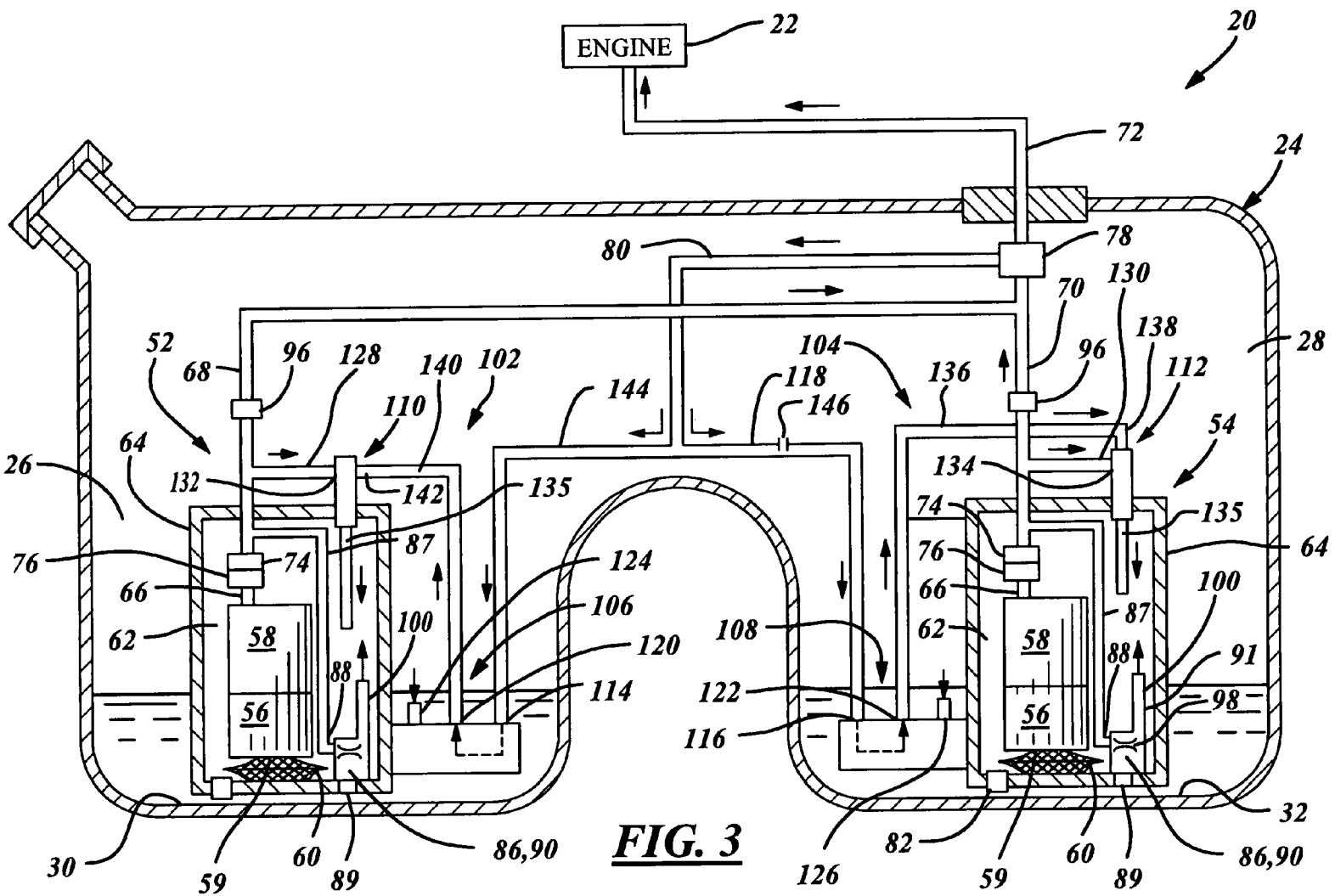
FIG. 3 is the partial section view of FIG. 1 except with both the first and second control valves being open.
Figure 4:
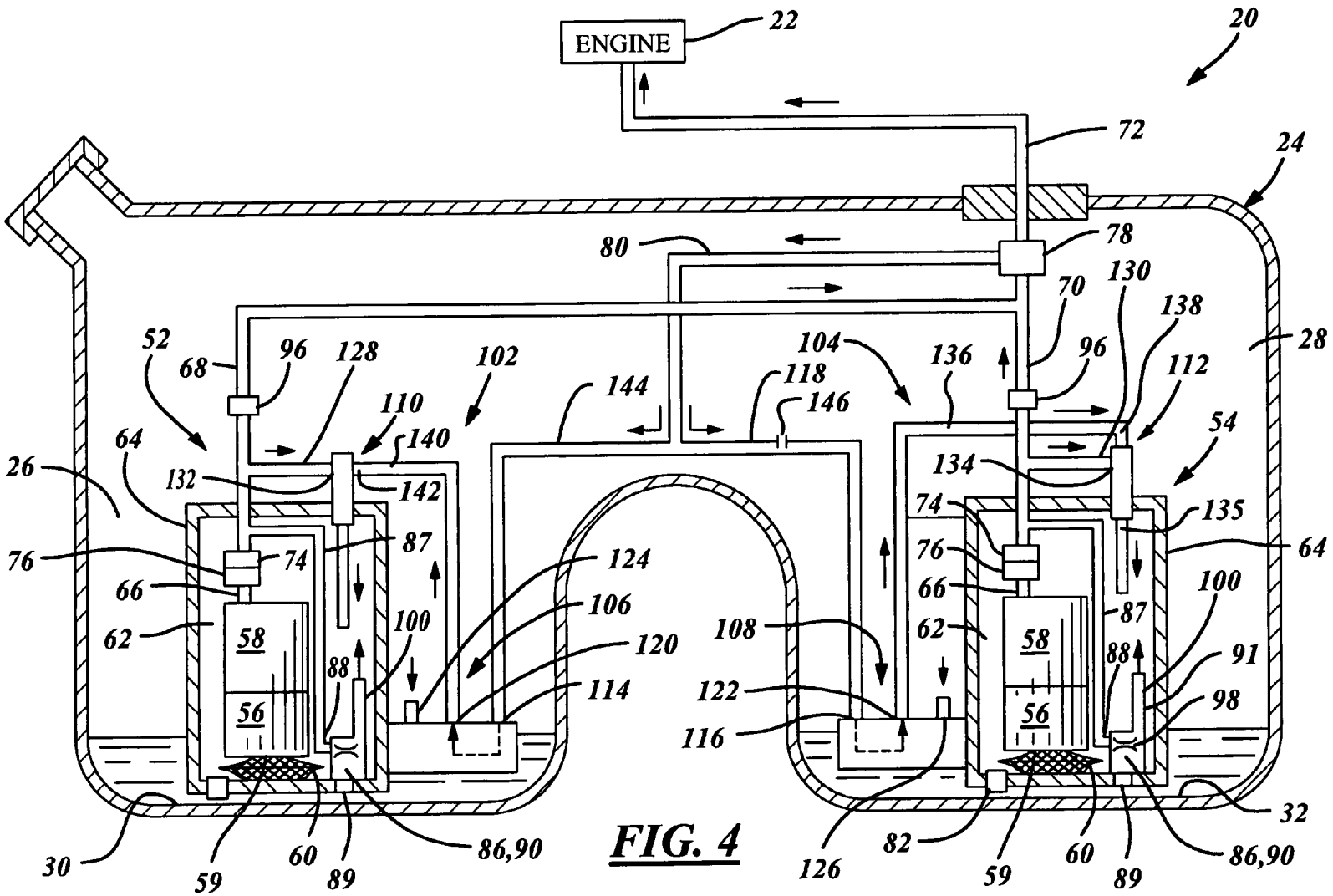
FIG. 4 is the partial section view of FIG. 1 except with both the first and second control valves being closed.

Referring to FIG. 3, when the fuel levels in the first and second fuel chambers 26, 28 are both high and both of the control valves 106, 108 are consequently open, fuel generally does not flow in either direction through the transfer conduit 118. Instead, each transfer jet 110, 112 will generally receive fuel from the inlet ports 124, 126 of the control valves 106, 108 of the respective jet assembly 102, 104. Referring to FIG. 4, when the fuel levels in the first and second fuel chambers 26, 28 are low and both of the control valves 106, 108 are consequently closed, fuel generally does not flow in either direction through the common transfer conduit 118. In fact, the transfer jets 110, 112 are generally inoperative and the reservoir jet pumps 86 are preferably generally relied upon to maintain a sufficient fuel level in the respective reservoir cans 64.

As illustrated in FIGS. 1–4, the pressure regulator 78 of the fuel system 20 preferably returns fuel by the bypass conduit 80 to preferably a mid-portion 114 of the transfer passage 118. The mid-portion 144 is generally higher than both ends 114, 116 of the transfer passage 118. The bypass fuel entering the transfer passage 118 will flow in the direction of lowest pressure. Hence, the fuel chamber having the lowest fuel level, regardless of whether the respective control valve is open or closed will generally receive the bypass fuel. For instance, and referring again to FIG. 1, if the fuel level in the first chamber 26 is high and fuel level in the second chamber 28 is low, the first control valve 106 is open and the second control valve 108 is closed. Fuel in the transfer passage 118 thus flows from the first chamber 26 to the second chamber 28. Fuel entering the transfer passage 118 from the bypass passage 80 will flow in the same direction toward the second fuel chamber 28 and into the second reservoir 62 which will generally ultimately overflow into the second fuel chamber 28.

Referring to FIGS. 5 and 6, the float control valve 106, and likewise valve 108, has a body 150 which generally carries the transfer port 114, the outlet port 120 and the inlet port 124. As previously described, the transfer port 114 and the inlet port 124 preferably communicate with each other continuously and through the body 150 of the valve 106 regardless of valve position (i.e. open or closed). The inlet port 124 is or generally carries an annular valve seat which is opened and closed by a valve head or member 152 engaged to a pivoting arm 154. A first end of the arm is engaged to the body 150 at a pivoting point 156 and an opposite second end 158 is connected to a float 160 preferably from above. Preferably, the float 160 is generally cylindrical and is vertically guided by a housing portion 162 of the body 150 defining a through bore.

Located generally at a high point or the mid-portion 144 of the transfer passage 118 is a small hole or aperture 146 for preventing fuel removal or evacuation from any one fuel chamber due to a siphoning effect when the fuel system 20 is inoperative. The aperture 146 is generally large enough to prevent siphoning yet small enough to have a negligible effect upon the operating dynamics of the fuel system 20 when the fuel pumps 56 are running.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

I claim:

1. A fuel delivery system for supplying liquid fuel to at least one combustion engine, the fuel delivery system comprising:

at least one fuel tank;

a first fuel chamber defined by the at least one fuel tank;

a second fuel chamber defined by the at least one fuel tank;

a first fuel pump having an inlet communicating with the first fuel chamber and a pressurized outlet communicating with the at least one combustion engine;

a fuel transfer conduit having a first end disposed in the first fuel chamber and a second end disposed in the second fuel chamber, wherein the second end is not disposed at the highest elevation of the transfer conduit;

a first transfer jet disposed in the first fuel chamber, the first transfer jet having a high pressure inlet communicating with the outlet of the first fuel pump, a low pressure inlet communicating continuously with the first end and communicating intermittently with the first fuel chamber and an outlet communicating with the first fuel chamber; and a first control valve disposed in the first fuel chamber, the first control valve having an inlet port communicating with the first fuel chamber, an outlet port and a transfer port, wherein the first control valve is constructed and arranged to isolate the inlet port from the outlet and transfer ports upon low fuel level in the first fuel chamber.

2. The fuel delivery system set forth in claim 1 wherein the first end of the transfer conduit is located near a first bottom of the at least one fuel tank defining in part the first fuel chamber, the second end is located near a second bottom of the at least one fuel tank defining in part the second fuel chamber, and a mid portion of the transfer conduit is disposed at a higher elevation than the first and second ends.

3. The fuel delivery system set forth in claim 1 further comprising a second fuel pump having an inlet communicating with the second fuel chamber and a pressurized outlet communicating with the at least one combustion engine.

4. The fuel delivery system set forth in claim 3 further comprising:

a second transfer jet disposed in the second fuel chamber, the second transfer jet having a high pressure inlet orifice communicating with the outlet of the second fuel pump, a low pressure inlet orifice communicating continuously with the second end and communicating intermittently with the second fuel chamber, and an aspiration outlet orifice communicating with the second fuel chamber; and a second control valve disposed in the second fuel chamber, the second control valve having an inlet port communicating with the second fuel chamber, an outlet port and a transfer port, wherein the second control valve is constructed and arranged to isolate the inlet port from the outlet and transfer ports upon low fuel level in the second fuel chamber.

5. The fuel delivery system set forth in claim 4 wherein the at least one fuel tank is a saddle tank.

6. The fuel delivery system set forth in claim 5 further comprising:

a first bottom of the saddle tank located near the first end of the transfer conduit;

a second bottom of the saddle tank located near the second end of the transfer conduit; and a mid portion of the transfer conduit being at a higher elevation than the first and second ends and having an anti-siphoning aperture communicating directly in the saddle tank.

7. The fuel delivery system set forth in claim 1 wherein the first control valve is a float valve.

8. The fuel delivery system set forth in claim 3 wherein the first and second control valves are float valves.

9. The fuel delivery system set forth in claim 1 further comprising a first reservoir can disposed in the first fuel chamber near the first bottom with the inlet of the first fuel pump located in the first reservoir can, the first reservoir can having a bottom hole communicating with the first fuel chamber.

10. The fuel delivery system set forth in claim 9 wherein the aspiration outlet orifice of the first transfer jet is disposed generally in the first reservoir can for filling the first reservoir can.

11. The fuel delivery system set forth in claim 9 further comprising a first reservoir jet located in the first fuel chamber and having a high pressure inlet orifice communicating with the outlet of the first fuel pump, a low pressure inlet orifice communicating with the first fuel chamber and an aspiration outlet orifice for filling the reservoir can with fuel from the first fuel chamber.

12. The fuel delivery system set forth in claim 10 further comprising a first reservoir jet located in the first fuel chamber and having a high pressure inlet orifice communicating with the outlet of the first fuel pump, a low pressure inlet orifice communicating with the first fuel chamber and an aspiration outlet orifice for filling the reservoir can with fuel from the first fuel chamber.

13. The fuel delivery system set forth in claim 3 further comprising:

a first reservoir can disposed in the first fuel chamber near the first bottom with the inlet of the first fuel pump located in the first reservoir can, the first reservoir can having a bottom hole communicating with the first fuel chamber;

a first reservoir jet located in the first fuel chamber and having a high pressure inlet orifice communicating with the outlet of the first fuel pump, a low pressure inlet orifice communicating with the first fuel chamber and an aspiration outlet orifice for filling the reservoir can with fuel from the first fuel chamber;

a second reservoir can disposed in the second fuel chamber near the second bottom with the inlet of the second fuel pump located in the second reservoir can, the second reservoir can having a bottom hole communicating with the second fuel chamber; and a second reservoir jet located in the first fuel chamber and having a high pressure inlet orifice communicating with the outlet of the first fuel pump, a low pressure inlet orifice communicating with the first fuel chamber and an aspiration outlet orifice for filling the reservoir can with fuel from the first fuel chamber.

14. The fuel delivery system set forth in claim 9 wherein the first fuel pump, the first reservoir can, the first reservoir jet, the first transfer jet and the first control valve are integrated as a fuel pump module disposed in the first fuel chamber.

15. The fuel delivery system set forth in claim 9 further comprising:

a first fuel pump module engaged to and disposed in the first fuel tank and having the first fuel pump, the first reservoir can, the first reservoir jet and the first transfer jet; and a second fuel pump module engaged to and disposed in the second fuel tank and having the second fuel pump, the second reservoir can, the second reservoir jet and the second transfer jet.

16. The fuel delivery system set forth in claim 3 further comprising a fuel supply conduit for flowing fuel from the pressurized fuel outlets of the first and second fuel pumps to one of the at least one combustion engine.

17. The fuel delivery system set forth in claim 3 further comprising:

a first fuel supply conduit for flowing fuel from the pressurized fuel outlet of the first fuel pump to a first combustion engine of the at least one combustion engine; and a second fuel supply conduit for flowing fuel from the pressurized fuel outlet of the second fuel pump to a second combustion engine of the at least one combustion engine.

18. The fuel delivery system set forth in claim 1 further comprising:

a first fuel supply conduit communicating between the pressurized fuel outlet of the first fuel pump to at least one fuel rail of the at least one combustion engine;

a pressure regulator constructed and arranged to control fuel pressure at the at least one fuel rail; and a bypass conduit communicating between the pressure regulator and the transfer conduit between the first and second ends for flowing a quantity of bypass fuel released controllably by the pressure regulator into the transfer conduit.

19. The fuel delivery system set forth in claim 3 further comprising:

a first fuel supply conduit communicating between the pressurized fuel outlet of the first fuel pump to at least one fuel rail of the at least one combustion engine;

a second fuel supply conduit communicating between the pressurized fuel outlet of the second fuel pump to the at least one fuel rail of the at least one combustion engine;

a pressure regulator constructed and arranged to control fuel pressure at the at least one fuel rail; and a bypass conduit communicating between the pressure regulator and the transfer conduit between the first and second ends for flowing a quantity of bypass fuel controllably released by the pressure regulator into the transfer conduit.

20. A fuel delivery system supplying liquid fuel to at least one combustion engine of a vehicle, the fuel delivery system comprising:

a first fuel tank;

a second fuel tank;

a first fuel pump having an inlet communicating with the first fuel tank and a pressurized outlet communicating with the vehicle conduit;

a first transfer jet having a high pressure inlet communicating with the pressurized outlet, a fuel outlet communicating with the first fuel tank and a low pressure inlet;

a first control valve located in the first fuel tank and having a first inlet port constructed and arranged to open upon high fuel level in the first fuel tank, a first outlet port communicating with the low pressure inlet and a first transfer port; and a second control valve located in the second fuel tank and having a second inlet port constructed and arranged to open upon high fuel level in the second fuel tank and a second transfer port communicating with the first transfer port.

21. The fuel delivery system set forth in claim 20 wherein the first and second control valves are float valves and the first and second inlet ports are annular valve seats.

22. The fuel delivery system set forth in claim 20 further comprising a second fuel pump orientated with the second fuel tank, a second transfer jet orientated with the second fuel tank, and an outlet port of the second control valve communicating with a low pressure inlet orifice of the second transfer jet.

23. The fuel delivery system set forth in claim 22 wherein the vehicle is an automobile.

24. The fuel delivery system set forth in claim 22 wherein the vehicle is a boat.

25. The fuel delivery system set forth in claim 24 wherein the first fuel tank is a port-side fuel tank and the second fuel tank is a starboard-side fuel tank.

26. The fuel delivery system set forth in claim 24 wherein the first fuel tank is a bow-ward fuel tank and the second fuel tank is a stern-ward fuel tank.

* * * * *